United States Patent [19]

Lindh et al.

[11] Patent Number: 4,910,884

[45] Date of Patent: Mar. 27, 1990

[54] SHOE SOLE INCORPORATING SPRING APPARATUS

[76] Inventors: Devere V. Lindh, 1910 Dogwood Dr., SE.; Fred A. Sutton, 1815 Dogwood Dr., SE., both of Auburn, Wash. 98002

[21] Appl. No.: 341,958

[22] Filed: Apr. 24, 1989

[51] Int. Cl.[4] ..... A43B 13/18

[52] U.S. Cl. ..... 36/28; 36/27

[58] Field of Search ..... 36/7.8, 27, 28, 29, 36/38

[56] References Cited

U.S. PATENT DOCUMENTS

| | | | |
|---|---|---|---|
| 4,592,153 | 6/1986 | Jacinto | 36/7.8 X |
| 4,638,575 | 1/1987 | Illustrato | 36/28 X |
| 4,843,737 | 7/1989 | Vorderer | 36/27 X |

FOREIGN PATENT DOCUMENTS

| | | | |
|---|---|---|---|
| 958766 | 9/1949 | France | 36/28 |

*Primary Examiner*—Paul T. Sewell

*Assistant Examiner*—Andrew D. Meyers

*Attorney, Agent, or Firm*—Robert W. Jenny

[57] ABSTRACT

The shoe sole incorporating spring apparatus comprises a shoe sole with a cavity in its upper side, the planform of the cavity being essentially that of the foot of a wearer of a shoe incorporating the sole. Two elliptical springs are situated entirely in the cavity, one spring located under the heel of the user, termed the heel spring, the other under the ball of the user's foot, termed the toe spring. The springs are contoured in planform to fit snugly but freely in the cavity. A flexible bridge piece fits over the springs. The planform of the bridge conforms closely to that of the cavity, allowing free motion of the bridge to the cavity. The springs and bridge are made of acetal plastic. The spring rates of the springs are attuned to the weight of the wearer, reaching full deflection under forces which are a factor times the weight of the wearer. The factor ranges from 1 to 4 with 3 being a preferred factor for the heel spring and 1.5 being a preferred factor for the toe spring in a walking shoe and 3 in a shoe intended for more vigorous use.

5 Claims, 1 Drawing Sheet

FIG. 1
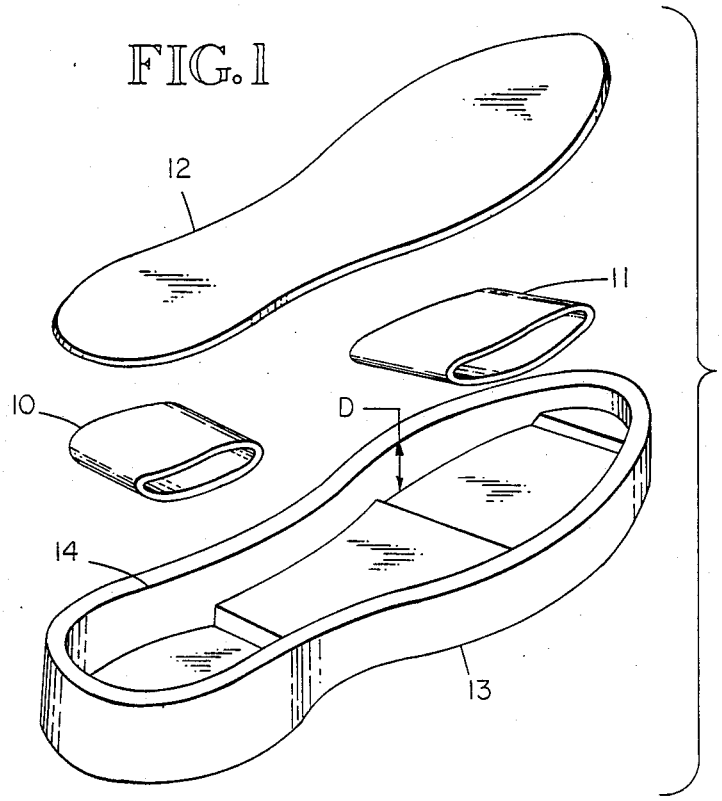
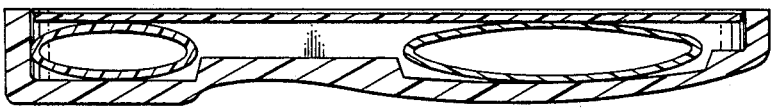
FIG. 2
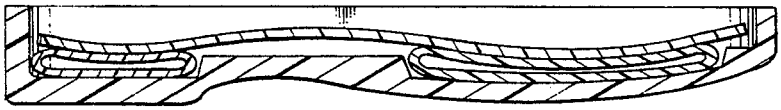
FIG. 3
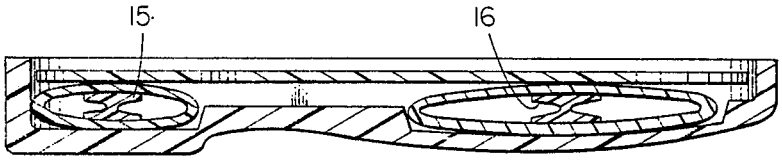
FIG. 4

SHOE SOLE INCORPORATING SPRING APPARATUS

BACKGROUND OF THE INVENTION

1. Field

This invention is in the field of footwear incorporating resilient apparatus for the purposes of (1) relieving and/or absorbing shock loads resulting from use of the footwear and (2) increasing the endurance of users of such footwear. More specifically it is in the field of such footwear incorporating springs in the soles of the footwear and still more specifically a spring positioned under the ball of the foot of a wearer and another positioned under the heel.

2. Prior Art

More than forty patents in the field have been examined by the inventors of the subject concept and many more patents, not reviewed by the inventors, are cited as references on the patents examined. Further, it is recognized that the examined and cited patents represent only a portion of the prior art in this field, dating back into the late 1890s. Of this prior art, U.S. Pat. No. 741,012, British Patent 1300 and Italian 284,482 are considered most pertinent to the subject application. Also U.S. patent application Ser. No. 217,769, Spring For Floors and the Like is definitely relevant prior art.

In spite of the profuse prior art, a clear need remains for better solutions to the problems addressed by the prior art and much effort is being made to find those solutions. The need remains for footwear which (1) significatly relieves (as different from absorbs) the shock loads encountered by users of the footwear and (2) reduces the effort required from a user of the footwear in specific activities such as hiking, aerobic exercise and sports activities such as basketball and track events. It is now well known in the art that for footwear to best meet the needs cited, the characteristics of the footwear must be attuned to the weight of the user and to the nature of the use. It is also well established that commercial success of such footwear requires that it be economical to manufacture as well as readily attunable to the weight of the user and the nature of the use. Also, it is established that the footwear must be within specific weight limits in order to best meet the needs cited, the weight being one factor to be attuned to the weight of the user.

Therefore the prime objective of the subject invention is provision of footwear which relieves shock loads experienced by the wearer. A second objective is that the footwear not significantly affect the energy required of the wearer in undertaking specific activities. A third objective is that the cost of the footwear not be unduly increased by the incorporation of the features needed to meet the first and second objectives. A fourth object is that the footwear be readily attunable to the characteristics of both the wearer of the footwear and the intended primary activity of the wearer. A fifth objective is that the footwear be clearly within the weight ranges known to be acceptable relative to the combined characteristics of the wearer and the primary intended use of the footwear.

SUMMARY OF THE INVENTION

The invention is footwear incorporating two springs per shoe, one in the heel portion and one essentially under the ball of the foot of a person wearing the footwear. The two springs are bridged by a flat resilient member which provides support to the arch of the wearer's foot. The springs are elliptical with their primary axes oriented in the toe/heel direction and their widths adapted to the widths of the sole as it varies from toe to heel. To meet the combined weight/performance requirements the springs are made to acetal plastic, Delrin® being a preferred material. The flat resilient member is fibre enforced Delrin®. The maximum deflections of the spring are attuned to the intended use of the shoe, ranging friom ¼ inch to ⅞ inch, depending on the use. The spring rates are attuned to the weight of the wearer and intended use as follows: The heel springs will reach maximum deflection under a force equal to 3 times the weight of the wearer for all intended uses. The ball springs, intended for walking, will reach maximum deflection under a force equal to 1.5 times the weight of the wearer and, if intended for more aerobic use, in the force range between 1.5 and 3 times the weight of the wearer. A force range between 1 and 4 is considered all-inclusive.

The springs are made in a range of planform shapes and sizes to suit various shoes sizes. The attuning of spring rate is achieved by selection of the wall thickness of the springs. The maximum deflection is attuned by either the cross-sectional dimensions of the spring or insertion of a deflection limiter or both. The shoes are made so that the springs are removeable, replaceable and, if desired, interchangeable.

The invention is described in more detail below with reference to the attached drawings.

BRIEF DESCRIPTION OF THE DRAWINGS

FIG. 1 is an exploded perspective view of the spring apparatus and a shoe sole adapted to receive it.

FIG. 2 is a vertical longitudinal sectional view of the apparatus in the shoe sole, the apparatus in the no-load condition.

FIG. 3 is a vertical longitudinal sectional view of the apparatus in the shoe sole with both springs loaded to maximum deflection.

FIG. 4 shows the apparatus of FIG. 3 with deflection limiting means in place.

DETAILED DESCRIPTION OF THE INVENTION

The subject invention is a shoe sole incorporating spring apparatus installed in the shoe sole. As shown in FIG. 1, an exploded perspective view of the shoe sole and installed apparatus, the apparatus comprises a heel spring 10, a spring 11 located to be engaged by the ball of the user's foot and termed a toe spring, a bridge element 12 and the shoe sole 13. Cavity 14 in the upper side of the shoe sole is shaped to receive the springs, and position them accurately while allowing clearance for free deflection action of the springs. The planform of the cavity essentially matches the footprint of the user of the shoe sale and has a heel portion and a toe portion. The depth D of the cavity is such that the bridge fits within its confines over the undeflected springs; i.e. the sum of the undeflected heights of the springs plus the thickness of the bridge does not exceed the depth of the cavity.

Each of the springs is a single piece spring having an essentially elliptical cross-section. In plan view each spring is shaped to fit snugly but freely into its portion of the cavity. The springs are symmetrical about a plane through the major axis of their essentially elliptical planform and thus can be used in both left and right shoes of a pair. The springs are made of an acetal plastic, Dupont Delrin® being a preferred material. This material provides an optimum strength to weight ratio, enabling keeping the spring weights to a minimum, has excellent fatigue characteristics, can be molded to form the springs and is corrosion resistant.

The bridge is a flat spring of uniform thickness and having a planform conforming to the planform of the cavity such that it fits freely but closely in the cavity in the sole. The bridge serves to provide a relatively flat contact surface for the user's foot and to hold any inner soles or arch supports used in the shoe.

FIG. 2 is a vertical, longitudinal sectional view of the apparatus with the springs in the no-load, undeflected condition. FIG. 3 is a similar view but with both springs fully deflected. FIG. 4 is also a view similar to FIG. 1 but with both springs fully deflected with the deflection limited by blocks 15 and 16. These blocks may be attached adhesively to the springs or made integral with the springs.

Whatever the maximum deflection of each spring is, its spring rate is made such that it reaches maximum deflection under specific loads expressed as a factor times the user's weight. For example, in a preferred embodiment of the apparatus for use in walking, the maximum deflection load for the heel spring is 3 times the weight of the user, and for the toe spring, 1.5 times the weight of the user. In an embodiment for use with more vigorous exercises, such as aerobic dancing or basketball, the maximum deflection loads for both springs are 3 times the weight of the user. Useful maximum deflection loads for the springs range from 1 to 4 times the weight of the user.

The spring rates of the springs are a function of the wall thicknesses of the springs. The outside dimensions of the springs for a given shoe size are kept constant and the inside dimensions vary with the varying wall thickness. Therefore springs having various spring rates are interchangeable in given shoe sizes. Since the stiffness of the spring varies with the cube of their wall thicknesses, thickness variation over the range of spring rates is small and does not significantly affect the maximum deflection which is effected by contact of the top and bottom of the springs.

The freedom of movement of the spring apparatus and the low internal damping of the acetal plastic from which they are made assure that energy stored in the springs during shock relieving deflections is returned almost entirely to the user as the loads are lightened when the foot is lifted.

It is considered understandable from this description that the subject invention meets its objectives. The springs with capabilities as specified, related to the user's weight, relieve shock loads. Little energy is absorbed by the spring apparatus and therefore the energy required of the user in specific activities is not significantly affected. There are few parts and they are not detailed or complicated; hence, the cost of incorporating them in a shoe sole does not unduly increase the cost of the footwear. The apparatus is readily attunable to the characteristics of the wearer and the intended activity of the wearer. The physical characteristics of the acetal plastic parts and their simplicity keep the weights of the shoes incorporating the apparatus clearly within acceptable weight ranges for shoes intended for the combined characteristics of the users and the intended use.

It is also understandable that while preferred embodiments of the invention are disclosed, other embodiments and modifications of those enclosed are possible within the scope of the invention which is limited only by the attached claims.

I claim:

1. A shoe sole for incorporation into a shoe for use by a user and incorporating spring apparatus, said shoe sole having an upper side and a cavity in said upper side, said cavity having a planform and a depth, said cavity having a heel portion and a toe portion, said spring apparatus comprising a heel spring, a toe spring and a bridge, said heel spring having an essentially elliptical cross-section, a wall thickness, a height, a planform and a maximum deflection, said toe spring having an essentially elliptical cross-section, a wall thickness, a height, a planform and a maximum deflection, said planform of said heel spring conforming to said heel portion of said cavity such that said heel spring fits snugly but freely in said heel portion of said cavity, said planform of said toe spring conforming to said toe portion of said cavity such that said toe spring fits snugly but freely in said toe portion of said cavity, said bridge being a flat spring having a thickness and a planform, said planform conforming to said sole cavity planform such that said bridge fits snugly but freely in said cavity, said heel spring being inserted into said heel portion of said cavity, said toe spring being inserted into said toe portion of said cavity, said bridge being inserted into said cavity over said heel and toe springs, the sum of said height of said heel spring and said thickness not exceeding said depth and the sum of said height of said toe spring and said thickness not exceeding said depth.

2. The shoe sole of claim 1 in which said user has a weight and said spring rate of said heel spring is such that said maximum deflection of said heel spring is achieved by application of a force equal to a first factor times said weight, said first factor being in the range of 1 to 4, said spring rate of said toe spring is such that said maximum deflection of said toe spring is achieved by application of a force equal to a second factor times said weight, said second factor being in the range of 1 to 4.

3. The shoe sole of claim 2 in which said first factor is 3 and said second factor is 1.5.

4. The shoe sole of claim 2 in which said first factor is 3 and said second factor is 3.

5. The shoe soles of claims 1, 2, 3 or 4 in which said heel spring, toe spring and bridge are made of acetal plastic.

* * * * *